US006085934A

United States Patent [19]

Sene et al.

[11] Patent Number: 6,085,934

[45] Date of Patent: Jul. 11, 2000

[54] CAN WITH A PRESSURE LID

[75] Inventors: Antonio Roberto Sene; Antonio Carlos Teixeira Alvares, both of São Paulo, Brazil

[73] Assignee: Brasilata S.A. Embalagens Metálicas, Sao-Paulo, Brazil

[21] Appl. No.: 09/065,600

[22] Filed: Sep. 10, 1997

[30] Foreign Application Priority Data

Aug. 7, 1997 [BR] Brazil ..... 9702736

[51] Int. Cl.[7] ..... B65D 41/16

[52] U.S. Cl. ..... 220/789

[58] Field of Search ..... 220/FOR 100, 220/789, 791, 801

[56] References Cited

U.S. PATENT DOCUMENTS

| | | | |
|---|---|---|---|
| 1,385,290 | 7/1921 | Welling | 220/801 |
| 2,074,231 | 3/1937 | Meacham | 220/789 |
| 2,092,118 | 9/1937 | Hodgson | 220/801 |
| 3,200,986 | 8/1965 | La Grutta | 220/791 |
| 3,347,408 | 10/1967 | Baker, Sr. | 220/789 |
| 3,388,827 | 6/1968 | Thanhuaser et al. | 220/791 |
| 4,090,636 | 5/1978 | Norton | 220/789 |
| 4,171,063 | 10/1979 | Cloutier | 220/789 |
| 4,606,474 | 8/1986 | Dedzik | 220/789 |
| 4,679,699 | 7/1987 | Malsbury et al. | 220/789 |

*Primary Examiner*—Allan N. Shoap
*Assistant Examiner*—Robin A. Hylton
*Attorney, Agent, or Firm*—Darby & Darby

[57] ABSTRACT

A can has a flange extending inwardly from a vertical wall and with a downwardly extending skirt wall defining an opening, a lower section of the skirt wall having continuously curved to form a first rib of open tubular shape of a substantial part of a circle around a lower end of the flange skirt wall. There is a lid for fitting into and sealing the can opening, the lid having a peripheral wall therearound with an end of an upper section having a second rib to engage a top of the can flange, a central wall portion below the second rib to oppose the flange downwardly extending skirt wall above the can first rib, and a recess around the lid peripheral wall below the central wall portion of a substantially V-shape with diverging walls. The can tubular first rib fits into the lid recess to engage at points along lines tangent tc the first rib extending around the circumference of the first rib with the points of engagement of the first rib with the diverging walls of the recess forming a lock between the lid and can flange and to seal the contents in the can from entering between the opposing lid central wall portion and flange skirt wall.

12 Claims, 1 Drawing Sheet

CAN WITH A PRESSURE LID

FIELD OF THE INVENTION

The present invention relates to a can, usually made from metal sheet material and of the type comprising a tubular body with a bottom wall and an upper flange wall having an inner peripheral edge which defines a seat for seating and retaining a lid. Particularly, the invention refers to an improvement in the retention and sealing for the lid of these cans.

BACKGROUND OF THE INVENTION

Metal cans have been known for having a structural top flange wall secured to the upper edge of the can tubular body and including a depending inner skirt defining the opening for accessing the inside of the can. The skirt also serves as a seat, to which is pressure fittable the peripheral wall of a sealing lid. The lid is manually removable and also recloseable during the period the can is used.

In these prior art cans, the sealing and the axial retention of the lid in the mounted position are achieved by pressure seating a peripheral wall of the lid against the inner surface of the depending skirt of the can flange wall. This type of construction has some deficiencies resulting from the small amount of axial locking force of the lid to the can and also from the fact that the free lower edge of the skirt is in contact with the product in the can.

In order to eliminate the aforementioned deficiencies, there has been developed a can and lid as described in the copending patent application P19600454 currently to U.S. Pat. No. 5,899,352 of the same applicant, according to which the axial locking of the lid is achieved by providing, in one of the parts defined by the can skirt wall forming the opening and the lid peripheral wall of an annular rib that is fittable in a corresponding circumferential recess on the lid peripheral wall or can skirt and having a section similar to that of the annular rib. In this construction, the rib and the recess have substantially coincident profiles of a semicircular shape, defined so that said parts fit each other with a substantially complete contact between the confronting surfaces.

While this arrangement provides a substantial axial force for locking of the lid, avoiding its undue opening due to shocks, internal pressure increase, etc., and allowing an adequate degree of sealing of the can contents to be achieved, keeping the canned product out of contact with air, this construction has the disadvantage of requiring great precision in the formation of the annular rib and circumferential recess.

Due to dimensional imperfections that can exist in these cans, the fitting between the rib and the corresponding circumferential recess sometimes can have a radial gap, thereby reducing the contact between the respective confronting surfaces to only one point of tangency along a line that develops around the circumference of the rib and recess. This contact does not guarantee an adequate sealing for the can, allowing the canned product to deteriorate.

Another deficiency of the known constructions for the can and lid refers to the achievement of automatic closing of cans at the filling units. Cans in which the conventionally secured peripheral edge of the inner ring of the can is on a plane which is at the same level or slightly above the plane of the upper edge of the lid seated at the central opening in some cases have an inadequate closing of the lid. There will be insufficient introduction and pressure of the lid against the can when the latter is moved under the closure roll or piston of the filling machine.

Still another deficiency of the known constructions refers to the accumulation of the product which is spilled over the structural ring of the can during the progressive removal of the can contents, making subsequent closings of the lid more difficult and consequently making possible the contact of air with the product inside the can. This allows, for example, the oxidation of the product and also, in the case of products having volatile elements in their composition, such as paints, the evaporation of said elements, causing the hardening of the remaining product in the can.

DISCLOSURE OF THE INVENTION

It is therefore an object of the present invention to provide a can with a lid having improved axial retention and sealing without requiring great dimensional precision or complexity in the formation of the parts of the lid and can that are to be interlocked.

It is also an object of the present invention to provide a can of the type described above which reduces the problem of product accumulation over the can opening ring upon repeated openings and closings of the lid and loss of sealing efficacy of the reclosed can.

It is still another object of the present invention to provide a can as described above which permits a safe closing of the lid at product filling units.

These and other objectives and advantages of the present invention are achieved through a can comprising a tubular body which has a top flange wall, incorporating a pending skirt defining the can opening which receives a peripheral wall of a lid. One of the parts defined by the peripheral wall of the lid and can skirt includes a circumferential rib which is fittable, in a closed can condition, in a corresponding circumferential recess provided on the other of said parts. At least one of said parts is elastically deformable to allow the fitting and removal of the lid. The circumferential recess and the circumferential rib are shaped and dimensioned so that, in a closed can condition, they may be mutually seated at points of tangency along at least two lines which are around the circumference of the lid and recess circumferential lines. The points of tangency are in planes which are parallel and axially displaced relative to each other. The tangency points of engagement are radially external to the innermost radial circumferential line of the rib, and the plane of the point of tangency is lower than the plane of the innermost radial circumferential line.

BRIEF DESCRIPTION OF THE DRAWINGS

The invention will be described below with reference to the attached drawings, in which.

BEST WAY OF CARRYING OUT THE INVENTION

Figure 1:
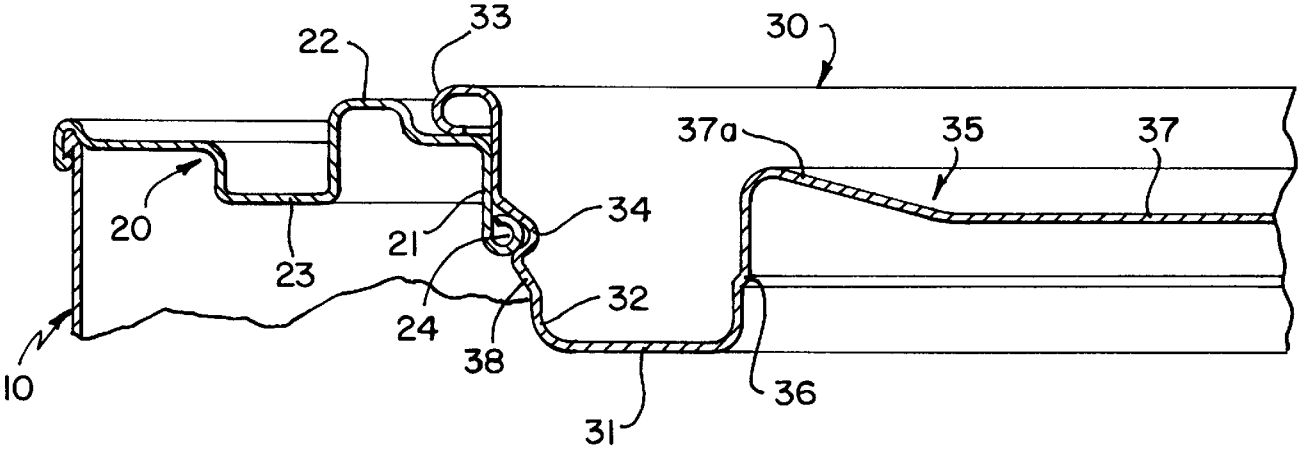
FIG. 1 represents schematically a partial diametrical section view of the upper portion of a can which is closed by a pressure lid and built according to the present invention.
Figure 2:
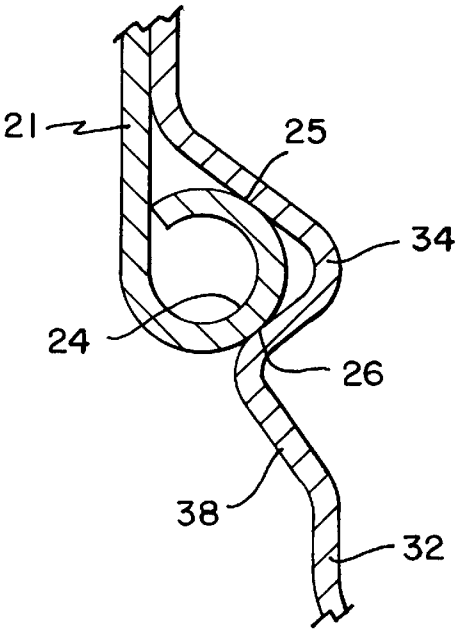
FIG. 2 represents schematically an enlarged view of part of FIG. 1 showing the locking and sealing between the lid and the can.

The present invention will be described according to what is illustrated in FIGS. 1 and 2, in relation to a can comprising a tubular body 10 of any suitable contour, e.g., cylindrical, to whose upper edge is conventionally secured a flange wall 20 whose inner peripheral edge is a depending skirt 21 which defines a generally circular upper opening and also forming the seat onto which is seated and retained a lid 30.

The flange wall 20 also is shaped to have a reinforcing upper annular rib 22, obtained by folding the sheet of the wall 20. The flange rib 22 is of an inverted "U" shape with rounded edges and projecting above the medium plane of the flange wall 20. There is also a usual lower annular rib 23 projecting below the plane of the flange wall 20 and which is closer to the edge of the can.

The provision of the reinforcing upper flange rib 22 allows achieving a greater stiffening of the flange wall 20 of the can, reducing the thickness of the sheet that forms the flange wall, with a consequent reduction of material consumption.

In the illustrated construction, the free end of the depending skirt 21 is curved upwardly back toward the inner surface of the skirt 21 to define a circumferential rib 24, which is tubular and has, for example, a substantially circular cross-section.

The lid 30 has a bottom wall 31, from which is upwardly projected a peripheral wall 32 whose free end is a curved upper peripheral edge 33. It should be noted that the dimensioning of the flange wall 20, reinforcing upper annular rib 22, and peripheral edge 33 of the lid 30 is such that the plane which contains said upper peripheral edge 33 of the lid 30 in a closed condition is located above the planes which contain, respectively, the top of the flange wall reinforcing upper annular rib 22. Since the plane containing the upper peripheral edge 33 of the lid 30 is the one more axially upwardly located, it will be guaranteed that the action of a lid closure means if a product canning unit, such as a roll and piston, against the lid will engage the edge 33 and, consequently, ensure the full automatic closing of the latter.

The peripheral depending wall 32 of the lid 30 is provided with a circumferential recess 34. The recess is formed by deformation of the wall 33 and is medianly located, for locking the lid 30 to the can, as described hereinafter.

In the closing condition of the can, the circumferential recess 34 of the lid 30 is fitted by being seated against the circumferential rib 24 of the can skirt 21. In this condition, the peripheral wall 32 of the lid 30 above the recess 34 is seated against the can flange depending skirt 21 and the upper peripheral edge 33 of the lid 30 is seated on the can flange wall 20, thereby limiting the fitting axial displacement of the lid 30.

The can circumferential rib 24 and the lid circumferential recess 34 are dimensioned in order to keep the lid 30 fitted in the can, avoiding spontaneous openings, but allowing the removal of the lid 30 when the user applies an axial extraction force. The release occurs with an elastic deformation of the depending skirt 21 of the flange wall 20, sufficient to separate the circumferential rib 24 from the lid circumferential recess 34.

The bottom wall 31 of the lid 30 is provided with an upwardly projecting central tubular drawn back portion 35, in order to provide additional internal volume to the can when closed and also providing additional safety to the can against spontaneous opening of its lid due to an internal pressure increase.

The tubular drawn back portion 35 has an annular step 36 which reduces the diameter of an upper portion of said tubular drawn back portion 35, and which defines a stop to avoid the introduction of another lid when cans are stacked. The tubular drawn back portion 35 further has on its upper end wall 37 an inclined circumferential plane 37*a* for structural reinforcement of the lid.

The peripheral wall 32 of the lid 30 also has a lower edge 38, defining a ramp along which slides the circumferential rib 24, through elastic deformation of at least one of the peripheral wall 32 of the lid 30 and can flange depending skirt 21, during the downward displacement of the lid toward the closed portion.

According to the illustrated embodiment, the circumferential rib 24, having a circular cross-section, and the lid circumferential recess 34 are shaped and dimensioned so that in a closed can condition, the parts mutually seat at least two points of engagement along tangency lines 25, 26 between the circumferential rib 24 of the depending skirt 21 and the circumferential recess 34. This type of contact exists around the circumference of each of the rib 24 and recess 34. The points of tangency engagement of the rib 34 on the lines 25, 26 are axially vertically displaced relative to each other, in respective planes which are mutually parallel and transverse to the can axis. They are also radially external relative to the can center to the innermost radial circumferential line of the circumferential groove 24.

According to the present invention, the mutual seating engagement points between the circumferential rib 24 and recess may occur along a plurality of such tangency lines, one of said points being inwardly placed in relation to the radially innermost line of the rib 24 in order to actuate the locking of the lid 30 to the can. In this case, said point of engagement also aids in the sealing of the can. In the illustrated construction of the circumferential recess 34 being in the lid 30, the peripheral wall 32 of the latter is shaped in order to define, below the portion of said wall provided with the circumferential recess 34, a displacement surface along the can circumferential rib 24 during the positioning of the lid 30 to a closed condition.

As illustrated, the tangency lines 25, 26 are defined by the contact between the respective ramp surface portions of the circumferential recess 24 and the circumferential rib 24.

According to the present invention, the contact surfaces along the tangency lines 25, 26 are defined and kept by an elastic deformation of at least one of said pending skirt 21 and circumferential recess 34 parts, the part being defined in function of the positioning of the tangency lines 25, 26 in relation to the innermost circumferential line of the rib 24.

In one embodiment of the present invention, at least one of said points of engagement along a tangency line 25, 26 is below the plane of the innermost circumferential point of the rib. In an embodiment in which both the points of rib and recess engagement along the tangency lines 25, 26 are below the innermost circumferential point of the rib 24, the seating of the upper peripheral edge 33 of the lid 30 against the structural flange wall 20 works as a stop to limit the introduction of the lid 30 into the can and also as a keeper of the seating condition on said tangency lines 25, 26. In this condition, both points of engagement of rib 24 and recess 34 on the tangency lines 25, 26 around the circumference of each operate to achieve the locking of the lid to the can in a closing condition, the innermost circumferential point of rib 24 further assuring a sealing of the inner content of the can. In this embodiment, keeping the closed lid condition is achieved through an elastic deformation of the depending skirt 21.

In the illustrated embodiment, the tangency lines 25, 26 are defined inclined opposite to each other in relation to the plane of the innermost circumferential point of the circumferential rib 24. In this embodiment the mutual seating condition between the circumferential rib 24 and the circumferential recess 34 is achieved though linear mutual actuation and is maintained by an elastic deformation of the depending skirt 21 and circumferential recess 34 parts. The seating of the upper peripheral edge 33 of the lid 30 against the flange wall 20 works only as a stop for limiting the introduction of the lid 30 into the can.

The dimensioning of the circumferential rib 24 and circumferential recess 34 parts is defined so that at least one of these circumferential regions, e.g. the one lower in relation to the circumferential rib 24, in the case of the tangency lines being at opposite sides in relation to the innermost circumferential point of the rib 24 retains the lid 30 to the can until an axial force applied upward for extracting the lid 30, results in a radial force on the circumferential region which retains the lid 30 to the can over the circumferential rib 24, is sufficient to produce an elastic deformation in at least one of the depending skirt 21 and lid 30 parts, for releasing the mutual fitting obtained in the closing condition of the lid 30 in relation to the can.

In order to avoid problems resulting from dimensional imprecision in the construction of the circumferential rib 24 and circumferential recess 34, the latter is defined with a curved portion having a smaller radius than the radius which constitutes the circumferential recess 34, so that in the fitting condition of lid 30 in the central opening of the can, the curvature center of the circumferential recess 34 and circumferential rib 24 parts are eccentrically positioned in relation to each other.

The circumferential recess 34 is generally "V" shaped, having a rounded vertex, determined so that the rib 24 and recess 34 point of engagement on tangency line 26 is below the innermost circumferential point of the circumferential rib 24 during the fitting condition of the lid 30 into the can. This guarantees that accidental upward axial forces on the lid 30 does not result in its removal from the can.

The rib and recess points of engagement on the tangency lines 25 and 26 around the circumference of each provide a pair of seals for sealing the lid 30 to the can which, besides avoiding the involuntary opening of the can, guarantee, independently from dimensional variations between the circumferential recess 34 and circumferential rib 24 parts, the air-tight sealing of the product stored inside the can.

Although not illustrated, other constructions are possible for the present invention, as for example, the provision of at least one circumferential rib which is fittable in a corresponding circumferential recess, which rib and recess can be provided in any of the parts defined by the depending skirt 21 of the can and peripheral wall 32 of the lid 30.

What is claimed is:

1. The combination comprising:

a can having a flange extending inwardly from a vertical wall of said can, said flange having a downwardly extending skirt wall defining an opening, a lower section of said skirt wall being continuously curved to form a first rib of open tubular shape of a substantial part of a circle around a lower end of said flange skirt wall;

a lid for fitting into and sealing said can opening, said lid having a peripheral wall therearound with an end of an upper section of said lid peripheral wall having a second rib to engage the top surface of said can flange;

a central wall portion below said second rib to oppose said flange downwardly extending skirt wall above said can first rib; and a recess around said lid peripheral wall below said central wall portion of a substantially V-shape with diverging walls, said can tubular first rib fitting into said recess to have an engagement substantially only at a point with the surface of each of said groove diverging walls along a respective line tangent to said first rib at the point of engagement with the respective diverging wall and extending around the circumference of said first rib to form a lock between said lid and said can flange and to seal the contents in said can from entering between the opposing lid central wall portion and said flange downwardly extending skirt wall.

2. The combination according to claim 1, wherein the points of engagement along the tangency lines are defined and retained by an elastic deformation of at least one of said skirt and circumferential recess.

3. The combination according to claim 2, wherein there is a point of engagement along each of two tangency lines opposite to each other in relation to the plane of the innermost circumferential line of said first rib.

4. The combination according to claim 3, wherein the points of engagement of the rib with said groove diverging walls extend around the circumference of the rib in two axially spaced planes parallel to each other.

5. The combination according to claim 1 wherein the points of contact along said tangency lines are defined by contact of the respective surface portions of the walls of said circumferential recess against said first rib.

6. The combination according to claim 1, wherein said first rib has a substantially circular shape.

7. The combination according to claim 1, wherein said lid peripheral wall lower edge defines a ramp, along which said first rib slides by elastic deformation of at least one of said peripheral wall and said skirt during the downward displacement of the lid to the closed position.

8. The combination according to claim 1, wherein said can flange is formed with a reinforcement annular groove below a plane which contains an upper peripheral edge of said lid projected above the plane of the upper edge of the can body.

9. The combination according to claim 1, wherein said lid is provided, upwardly from its bottom wall, with a tubular drawn back portion, which is axial and median, and which has in an upper end wall a circumferential inclined plane.

10. The combination of claim 1 wherein the end of said lid peripheral wall upper section is continuously curved downwardly and around back toward the outside of said lid peripheral wall with a wall free end facing and opposing the outside of said lid peripheral wall to form said second rib of open tubular shape of a substantial part of a circle having a curved portion to engage the top surface of said can flange;

said lid second rib engaging said can flange, downward force on said lid moving the wall free end of said lid second rib toward said lid lateral wall.

11. The combination of claim 1 wherein the apex of said V-shaped recess is arcuate.

12. The combination of claim 1 wherein said can and said lid are of metal.

* * * * *